US009657381B2

(12) United States Patent
Murakami et al.

(10) Patent No.: US 9,657,381 B2
(45) Date of Patent: May 23, 2017

(54) HIGH-STRENGTH STEEL SHEET HAVING EXCELLENT ROOM-TEMPERATURE FORMABILITY AND WARM FORMABILITY, AND WARM FORMING METHOD THEREOF

(75) Inventors: Toshio Murakami, Kobe (JP); Elijah Kakiuchi, Kobe (JP); Hideo Hata, Kobe (JP); Naoki Mizuta, Kakogawa (JP); Tatsuya Asai, Kakogawa (JP)

(73) Assignee: Kobe Steel, Ltd., Kobe-shi (JP)

( * ) Notice: Subject to any disclaimer, the term of this patent is extended or adjusted under 35 U.S.C. 154(b) by 644 days.

(21) Appl. No.: 14/238,599

(22) PCT Filed: Aug. 15, 2012

(86) PCT No.: PCT/JP2012/070729

§ 371 (c)(1),
(2), (4) Date: Jun. 5, 2014

(87) PCT Pub. No.: WO2013/024861

PCT Pub. Date: Feb. 21, 2013

(65) Prior Publication Data

US 2014/0271331 A1 Sep. 18, 2014

(30) Foreign Application Priority Data

Aug. 17, 2011 (JP) ..... 2011-178477

(51) Int. Cl.

| | |
|---|---|
| ***C22C 38/00*** | (2006.01) |
| ***C22C 38/38*** | (2006.01) |
| ***C21D 8/02*** | (2006.01) |
| ***B21D 22/20*** | (2006.01) |
| ***C21D 9/46*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |

(52) U.S. Cl.

CPC ..... *C22C 38/38* (2013.01); *B21D 22/208* (2013.01); *C21D 8/0226* (2013.01); *C21D 8/0236* (2013.01); *C21D 9/46* (2013.01); *C22C 38/001* (2013.01); *C22C 38/002* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C21D 2211/001* (2013.01); *C21D 2211/002* (2013.01); *C21D 2211/008* (2013.01)

(58) Field of Classification Search

CPC ..... C21D 2211/00; C21D 2211/001; C21D 2211/002; C21D 2211/005; C21D 2211/008

See application file for complete search history.

(56) References Cited

U.S. PATENT DOCUMENTS

| | | | | |
|---|---|---|---|---|
| 7,252,724 | B2 * | 8/2007 | Tosaka | C21D 8/0226 148/651 |
| 7,468,109 | B2 | 12/2008 | Kashima | |
| 7,591,977 | B2 | 9/2009 | Ikeda et al. | |
| 7,767,036 | B2 | 8/2010 | Kashima et al. | |
| 7,887,648 | B2 | 2/2011 | Kinugasa et al. | |
| 8,197,617 | B2 | 6/2012 | Nakaya et al. | |
| 8,343,288 | B2 | 1/2013 | Murakami et al. | |
| 8,597,439 | B2 | 12/2013 | Ikeda et al. | |
| 2003/0041932 | A1 | 3/2003 | Tosaka et al. | |
| 2004/0031547 | A1 | 2/2004 | Tosaka et al. | |
| 2005/0150580 | A1 | 7/2005 | Akamizu et al. | |
| 2006/0169366 | A1 | 8/2006 | Yuse et al. | |
| 2008/0199347 | A1 | 8/2008 | Barges et al. | |
| 2008/0251160 | A1 | 10/2008 | Akamizu et al. | |
| 2009/0053096 | A1 | 2/2009 | Miura et al. | |
| 2009/0202384 | A1 | 8/2009 | Tosaka et al. | |
| 2009/0242085 | A1 | 10/2009 | Ikeda et al. | |
| 2009/0277547 | A1 | 11/2009 | Saito et al. | |
| 2010/0000633 | A1 | 1/2010 | Yokoi et al. | |
| 2010/0080728 | A1 | 4/2010 | Ikeda et al. | |
| 2010/0221138 | A1 | 9/2010 | Nakaya et al. | |
| 2010/0252147 | A1 | 10/2010 | Murakami et al. | |
| 2012/0009434 | A1 | 1/2012 | Hata et al. | |
| 2012/0012231 | A1 | 1/2012 | Murakami et al. | |
| 2012/0305144 | A1 | 12/2012 | Okamoto et al. | |
| 2013/0022490 | A1 | 1/2013 | Hata et al. | |
| 2013/0236350 | A1 | 9/2013 | Kakiuchi et al. | |
| 2013/0259734 | A1 | 10/2013 | Kakiuchi et al. | |
| 2013/0330226 | A1 | 12/2013 | Murakami et al. | |

FOREIGN PATENT DOCUMENTS

| | | |
|---|---|---|
| CN | 101263239 A | 9/2008 |
| CN | 101696483 A | 4/2010 |

(Continued)

OTHER PUBLICATIONS

Extended European Search Report issued Oct. 8, 2015 in Patent Application No. 12823369.9.

International Search Report issued Nov. 20, 2012, in PCT/JP12/070729 filed Aug. 15, 2012.

Written Opinion of the International Searching Authority issued Nov. 20, 2012, in PCT/JP12/070729 filed Aug. 15, 2012.

*Primary Examiner* — Scott Kastler

*Assistant Examiner* — Vanessa Luk

(74) *Attorney, Agent, or Firm* — Oblon, McClelland, Maier & Neustadt, L.L.P.

(57) ABSTRACT

This high-strength steel plate has a component composition including, by mass %, C: 0.02-0.3%, Si: 1-3%, Mn: 1.8-3%, P: 0.1% or less, S: 0.01% or less, Al: 0.001-0.1%, N: 0.002-0.03%, the rest consisting of iron and impurities. Said steel plate has a microstructure including, in terms of area ratio relative to the entire microstructure, each of the following phases: bainitic ferrite: 50-85%; retained γ: 3% or greater; martensite+the aforementioned retained γ: 10-45%; and ferrite: 5-40%. The C concentration (CγR) in the aforementioned retained austenite is 0.3-1.2 mass %, part or all of the N in the aforementioned component composition is solid solution N, and the amount of said solid solution N is 30-100 ppm.

14 Claims, No Drawings

(56) References Cited

FOREIGN PATENT DOCUMENTS

| | | | |
|---|---|---|---|
| EP | 1 191 114 | A1 | 3/2002 |
| EP | 1 686 194 | A1 | 8/2006 |
| JP | 2001-234282 | | 8/2001 |
| JP | 2003-193193 | | 7/2003 |
| JP | 2004-190050 | | 7/2004 |
| JP | 2005-36271 | | 2/2005 |
| JP | 2005-206943 | | 8/2005 |
| JP | 2006-118007 | | 5/2006 |
| JP | 2006-207017 | A | 8/2006 |
| JP | 2006-283131 | | 10/2006 |
| JP | 2007-31840 | | 2/2007 |
| JP | 2008-106350 | | 5/2008 |
| JP | 2011-31254 | | 2/2011 |
| JP | 2011-509341 | | 3/2011 |
| WO | 2011/093490 | A1 | 8/2011 |

* cited by examiner

HIGH-STRENGTH STEEL SHEET HAVING EXCELLENT ROOM-TEMPERATURE FORMABILITY AND WARM FORMABILITY, AND WARM FORMING METHOD THEREOF

TECHNICAL FIELD

The present invention relates to a high-strength steel sheet having excellent room-temperature formability and warm formability, and warm forming method of the high-strength steel sheet. The high-strength steel sheet of the invention includes a cold-rolled steel sheet, a hot-dip galvanizing-coated steel sheet, and a hot-dip galvannealing-coated steel sheet.

BACKGROUND ART

A steel sheet for an automobile frame component is required to be increased in strength in order to achieve collision safety and improvement in fuel efficiency. The steel sheet is therefore required to have certain press formability while having higher strength of 980 MPa class or higher. As well known, steel produced using a TRIP effect is effectively used to achieve high strength and excellent formability of the high-strength steel sheet of 980 MPa class or higher (for example, see PTL1).

PTL1 discloses a high-strength steel sheet that contains bainite or bainitic ferrite as a main phase and 3% or more by area ratio of retained austenite (γR). The high-strength steel sheet, however, has a total elongation of less than 20% at a tensile strength of 980 MPa or more at room temperature, and is therefore required to be further improved in mechanical properties (hereinafter, also simply referred to as "properties").

Moreover, although the TRIP steel sheet has excellent formability, a forming load of press working inevitably increases in correspondence to such high strength. Use of the TRIP steel sheet is therefore difficult depending on component size.

There has been proposed a technique referred to as hot press (or hot stamping) as a technique that decreases the forming load of press working, in which a steel sheet is pressed in a high temperature range of about 900° C. so that a forming load of press working is decreased, and is then controllably cooled to have a martensite microstructure, thereby achieving high strength (for example, see PTL2). However, this technique has disadvantages in manufacturing, such as extreme oxidization of a steel sheet during heating, long heating time, and indispensable cooling control. Hence, there has been required development of a technique that achieves reduction in forming load of press working and increase in strength in a relatively low temperature range.

CITATION LIST

Patent Literature

PTL1: Japanese Unexamined Patent Application Publication No. 2003-193193.

PTL2: Japanese Unexamined Patent Application Publication No. 2011-31254.

SUMMARY OF THE INVENTION

Problems that the Invention is to Solve

An object of the invention, which has been made in light of the above-described circumstances, is to provide a high-strength steel sheet that has an excellent room-temperature formability and exhibits an excellent warm-forming load reduction effect, while having a room-temperature strength of 980 MPa class or higher, and provide a warm forming method of the high-strength steel sheet.

Means for Solving the Problems

An invention according to claim 1 is a high-strength steel sheet having excellent room-temperature formability and warm formability, the steel sheet being characterized by having a composition including, by mass percent (the same applies to the following for the chemical components), C: 0.02 to 0.3%, Si: 1.0 to 3.0%, Mn: 1.8 to 3.0%, P: 0.1% or less (including 0%), 5: 0.01% or less (including 0%), Al: 0.001 to 0.1%, N: 0.01 to 0.03%, and the remainder consisting of iron and impurities, and having a microstructure containing phases of, by area ratio to the entire microstructure (the same applies to the following for the microstructures), bainitic ferrite: 50 to 85%, retained austenite: 3% or more, martensite and the retained austenite in total: 10 to 45%, and ferrite: 5 to 40%, wherein C concentration (CγR) in the retained austenite is 0.3 to 1.2 mass percent, and part or all of N in the composition exists as dissolved N, and the amount of the dissolved N is 30 to 100 ppm.

An invention according to claim 2 corresponds to the high-strength steel sheet having excellent room-temperature formability and warm formability according to claim 1, wherein dislocation density in the entire microstructure is $5\times10^{15}$ $m^{-2}$ or less.

An invention according to claim 3 corresponds to the high-strength steel sheet having excellent room-temperature formability and warm formability according to claim 1 or 2, wherein the composition further includes Cr: 0.01 to 3.0%, Mo: 0.01 to 1.0%, Cu: 0.01 to 2.0%, Ni: 0.01 to 2.0%, B: 0.00001 to 0.01%, Ca: 0.0005 to 0.01%, Mg: 0.0005 to 0.01%, and REM: 0.0001 to 0.01% of one or at least two elements.

An invention according to claim 4 is a warm forming method of a high-strength steel sheet, the method being characterized in that the high-strength steel sheet according to any one of claims 1 to 3 is heated to 100 to 250° C., and is then formed within 3600 sec.

Advantageous Effects of the Invention

According to the invention, high-strength steel sheet has a microstructure containing, by area ratio to the entire microstructure, bainitic ferrite: 50 to 90%, retained austenite: 3% or more, martensite and the retained austenite in total: 10 to 45%, and ferrite: 5 to 40%, wherein C concentration (CγR) in the retained austenite is 0.3 to 1.2 mass percent, and part or all of N in the composition exists as dissolved N, and the amount of the dissolved N is 30 to 100 ppm, thereby making it possible to provide a high-strength steel sheet that has an excellent room-temperature formability and exhibits an excellent warm-forming load reduction effect, while having a room-temperature strength of 980 MPa class or higher, and provide a warm forming method of the high-strength steel sheet.

MODE FOR CARRYING OUT THE INVENTION

As described above, the inventors have focused on a TRIP steel sheet, which contains bainitic ferrite including a submicrostructure (matrix) having a high dislocation density and retained austenite (γR), as with the above-described existing technique, and have conducted investigations to improve room-temperature formability and increase a warm-forming load reduction effect while certain room-temperature strength is ensured.

The inventors have considered that the warm-forming load reduction effect is further effectively increased through the following operation: the amount of dissolved N is increased to suppress the TRIP phenomenon (transformation behavior from retained austenite to martensite), which is used to achieve strength at room temperature, in working of a steel sheet in a temperature range of 100 to 250° C., so that strength is decreased in a warm range (the temperature range of 100 to 250° C.).

Specifically, to achieve increase in room-temperature strength and increase in warm-forming load reduction effect, the inventors have conducted investigations and have found that 5 to 40% by area ratio of ferrite is introduced into a matrix (parent phase) to decrease strength of the matrix, and area ratio of retained austenite (γR) is adjusted to be 3% or more, and C concentration (CγR) in the γR is adjusted to be 0.3 to 1.2 mass percent, thereby the TRIP phenomenon (strain-induced transformation) is accelerated so that work hardening is enhanced to increase strength, while the amount of dissolved N is adjusted to be 30 to 100 ppm so that the TRIP phenomenon is suppressed in a temperature range of 100 to 250° C. to decrease strength in such a temperature range, and consequently increase in room-temperature strength and increase in warm-forming load reduction effect are both achieved.

Through further investigations based on the above-described findings, the inventors have finally completed the present invention.

A microstructure characterizing the steel sheet of the invention is now described.

[Microstructure of Steel Sheet of the Invention]

As described above, the steel sheet of the invention is based on a microstructure of TRIP steel as with the above-described existing technique, but is different from the existing technique particularly in that the steel sheet contains a predetermined amount of ferrite, a predetermined amount of γR having a predetermined carbon concentration, and a predetermined amount of dissolved N.

[Bainitic Ferrite: 50 to 85%]

In the invention, "bainitic ferrite" refers to a submicrostructure including a certain bainite microstructure that has a lath microstructure having a high dislocation density, and is obviously different from a typical bainite microstructure in that the submicrostructure has no carbide therein, and is also different from a polygonal ferrite microstructure having a submicrostructure having no or an extremely low dislocation density or from a quasi-polygonal ferrite microstructure having a submicrostructure including fine sub-grains, etc. (see "Atlas for Bainitic Microstructures Vol.-1" issued by Basic Research Society of The Iron and Steel Institute of Japan). Through light microscope observation or SEM observation, this microstructure has an acicular shape, and is thus difficult to be discriminated. Hence, the microstructure must be identified through TEM observation to determine a clear difference from the bainite microstructure and the polygonal ferrite microstructure, etc.

In this way, the microstructure of the steel sheet of the invention contains bainitic ferrite, which is homogenous, fine, and ductile, and has a high dislocation density and high strength, as a parent phase, thereby making it possible to improve a balance between strength and formability.

In the steel sheet of the invention, the amount of the bainitic ferrite microstructure must be 50 to 85% (preferably 60 to 85% and more preferably 70 to 85%) by area ratio to the entire microstructure. This is because the above-described effects of the bainitic ferrite microstructure are thereby effectively exhibited. The amount of the bainitic ferrite microstructure is determined depending on a balance with the γR, and is recommended to be appropriately controlled to allow the bainitic ferrite microstructure to exhibit the desired properties.

[Containing at Least 3% of Retained Austenite (γR) by Area Ratio to Entire Microstructure]

Retained austenite γR is useful for increasing total elongation. At least 3% (preferably at least 5%, and more preferably at least 10%) of γR by area ratio to the entire microstructure must exist to allow γR to effectively exhibit such an effect.

[Martensite and the Retained Austenite (γR) in Total: 10 to 45%]

Although martensite is partially introduced in the microstructure to ensure certain strength, an excessive amount of martensite may degrade formability. Hence, the total of martensite and γR is limited to 10% or more (preferably 12% or more and more preferably 16% or more) and 45% or less by area ratio to the entire microstructure.

[Ferrite: 5 to 40%]

Ferrite is a soft phase and does not contribute to increase in strength, but is effective for increasing ductility. Hence, to improve a balance between strength and elongation, ferrite is introduced in a range of area ratio of 5% or more (preferably 10% or more and more preferably 15% or more) and 40% or less (preferably 35% or less and more preferably 30% or less), in which certain strength is ensured.

[C Concentration (CγR) in Retained Austenite (γR): 0.3 to 1.2 Mass Percent]

The C concentration CγR affects stability of transformation of γR to martensite during working, and is usable as an index of the stability. If CγR is excessively low, γR is unstable, and therefore deformation-induced martensite transformation may occur before a steel sheet, to which stress has been applied, is plastically deformed, and consequently the steel sheet is not provided with stretch formability. On the other hand, if CγR is excessively high, γR is excessively stable, and therefore even if a steel sheet is worked, deformation-induced martensite transformation does not occur, and consequently the steel sheet is also not provided with stretch formability. The C concentration CγR must be 0.3 to 1.2 mass percent to provide sufficient stretch formability. Preferably, CγR is 0.4 to 0.9 mass percent.

[Amount of Dissolved N: 30 to 100 ppm]

During deformation at room temperature, dissolved N is incorporated in the retained austenite, and does not hinder the deformation. On the other hand, in the temperature range of 100 to 250° C., since free-energetic stability of retained austenite typically increases, the TRIP phenomenon is suppressed during deformation, resulting in reduction in strength. Furthermore, the amount of the dissolved N increases in ferrite, and diffusion rate of N also increases; hence, moving dislocation is fixed during deformation, causing dynamic strain aging. Thus, movement of dislocation is suppressed by the strain aging, which thus decreases amount of dislocation accumulated in an interface between the parent phase and the retained austenite. This further enhances the transformation behavior from the retained austenite to martensite, i.e., enhances the suppression effect of the TRIP phenomenon, thus making it possible to increase the forming-load reduction effect. The lower limit of the amount of dissolved N is specified to be 30 ppm to allow the dissolved N to effectively exhibit such a function. However, if the amount of dissolved N is excessive, the effect of dynamic strain aging is excessively increased. This rather strongly suppresses deformation of a matrix, leading to reduction in ductility. Consequently, the upper limit of the amount of dissolved N is specified to be 100 ppm.

[Rest: Bainite (Including 0%)]

Although the steel sheet of the invention may be composed of only the above-described microstructures (a mixed microstructure of bainitic ferrite, martensite, retained austenite, and ferrite), the steel sheet may also contain bainite as a different type of microstructure within a range without degrading the functions of the invention. While bainite may necessarily remain in a manufacturing process of the steel sheet of the invention, the amount of bainite is preferably smaller. Bainite is thus recommended to be controlled to be 5% or less and preferably 3% or less by area ratio to the entire microstructure.

[Dislocation Density in the Entire Microstructure: $5\times10^{15}$ $m^{-2}$ or Less]

The reinforcing mechanism by the dislocation has a small temperature dependence in a temperature range of about 300° C. or less. Hence, when the TRIP effect is reduced in a range of 100 to 250° C., dislocation density is desirably decreased in some degree to further securely decrease strength, and is recommended to be $5\times10^{15}$ $m^{-2}$ or less. The dislocation density is more preferably $4\times10^{15}$ $m^{-2}$ or less, and most preferably $3\times10^{15}$ $m^{-2}$ or less.

[Measurement Method of each of Area Ratio of each Phase, C Concentration (CγR) in γR, Amount of Dissolved N, And Dislocation Density]

A measurement method of each of area ratio of each phase, C concentration (CγR) in γR, amount of dissolved N, and dislocation density is now described.

With the area ratio of each phase of the steel sheet microstructure, the steel sheet is Lepera-etched and is subjected to observation by transmission electron microscope (TEM; X1500). Through the observation, for example, a white region is defined as "martensite and retained austenite (γR)" for identification of a microstructure. Subsequently, area ratio of each phase is determined through observation by light microscope (X1000).

With the area ratio of γR and the C concentration (CγR) in γR, each test steel sheet is ground to the quarter thickness thereof, and is then chemical-polished for measurement by X-ray diffractometry (see ISIJ Int. Vol. 33, (1933), No. 7, p. 776).

With the area ratio of ferrite, the test steel sheet is nital-etched and is subjected to observation by scanning electron microscope (SEM; X2000). Through the observation, a black region is identified as ferrite for determination of area ratio.

With the amount of dissolved N, according to JIS G 1228, amount of precipitation-type N is determined by extraction residue analysis (mesh size 0.1 μm), and the amount of dissolved N is calculated by subtracting the total amount of precipitation-type N from the total amount of N in the steel.

The dislocation density is determined by a measurement method with X-ray half value width (see paragraphs [0021] to [0032] of Japanese Unexamined Patent Application Publication No. 2008-144233).

The composition constituting the steel sheet of the invention is now described. Hereinafter, any chemical component is measured in percent by mass.

[Composition of Steel Sheet of the Invention]

C: 0.02 to 0.3%

C is an indispensable element to produce a desired main microstructure (bainitic ferrite, martensite, and γR) while high strength is ensured, and must be added by 0.02% or more (preferably 0.05% or more, and more preferably 0.10% or more) to effectively exhibit such a function. However, a steel sheet containing more than 0.3% of C is unsuitable for welding.

Si: 1.0 to 3.0%

Si is an element that effectively suppresses formation of carbide through decomposition of γR. In particular, Si is also useful as a solidification reinforcement element. Si must be added by 1.0% or more to effectively exhibit such a function. Si is preferably added by 1.1% or more, and more preferably by 1.2% or more. However, addition of more than 3.0% of Si inhibits formation of the microstructure composed of bainitic ferrite and martensite, increases hot deformation resistance and thus facilitates embrittlement of a weld, and adversely affects a surface character of the steel sheet. Hence, the upper limit of the amount of Si is 3.0%. The upper limit is preferably 2.5%, and more preferably 2.0% or less.

Mn: 1.8 to 3.0%

Mn effectively operates as a solidification reinforcement element, and operates to accelerate formation of the microstructure composed of bainitic ferrite and martensite through acceleration of transformation. Furthermore, Mn is an indispensable element to stabilize γ, and to provide desired γR. In addition, Mn contributes to improvement in hardenability. Mn must be added by 1.8% or more to effectively exhibit such functions. Mn is preferably added by 1.9% or more, and more preferably by 2.0% or more. However, addition of more than 3.0% of Mn causes adverse influence such as billet cracking. Consequently, Mn is preferably added by 2.8% or less, and more preferably by 2.5% or less.

P: 0.1% or less (including 0%)

P, which is inevitably contained as an impurity element, is an element that may be added to ensure desired γR. However, addition of more than 0.1% of P degrades secondary workability.

Preferably, P is added by 0.03% or less.

S: 0.01% or less (including 0%)

S, which is also inevitably contained as an impurity element, is an element that forms a sulfide-based inclusion such as MnS as an origin of crack, leading to degradation in workability. Thus, the amount of S is preferably 0.01% or less, and more preferably 0.005% or less.

Al: 0.001 to 0.1%

Al, which is added as a deoxidizer, is an element that effectively suppresses formation of carbide through decomposition of γR in conjunction with Si. Al must be added by 0.001% or more to effectively exhibit such a function. However, excessive addition of Al results in wasteful saturation of the effect, and therefore Al is added up to 0.1%.

N: 0.01 to 0.03%

Since N reduces ductility of ferrite due to strain aging, N has been limited in content, or has been immobilized by a nitride formation element such as Al or Ti.

However, the steel sheet of the invention must contain a high amount of N compared with existing steel in light of actively using the dissolved N during warm forming as described above. Hence, the lower limit of the N content is specified to be 0.01% (100 ppm) to ensure a certain amount of dissolved N. However, excessively high content of N makes it difficult to cast low-carbon steel such as the material of the invention, and thus prevents fabrication of the material. Hence, the upper limit of N content is specified to be 0.03%.

The steel of the invention essentially contains the above-described components, and contains the remainder that substantially consists of iron and inevitable impurities. In addition, the following allowable components can be added within the range without degrading the functions of the invention.

Cr: 0.01 to 3.0%,
Mo: 0.01 to 1.0%,
Cu: 0.01 to 2.0%,
Ni: 0.01 to 2.0%, and
B: 0.00001 to 0.01%.

These elements are each useful as a reinforcement element of steel, and are each effective for stabilizing γR and for ensuring the predetermined amount of γR. To allow each element to effectively exhibit such functions, 0.01% or more (preferably 0.05% or more) of Cr, 0.01% or more (preferably 0.02% or more) of Mo, 0.01% or more (preferably 0.1% or more) of Cu, 0.01% or more (preferably 0.1% or more) of Ni, and 0.00001% or more (preferably 0.0002% or more) of B are each recommended to be added.

However, even if more than 3.0% of Cr, more than 1.0% of Mo, more than 2.0% of Cu, more than 2.0% of Ni, and more than 0.01% of B are each added, the above-described effects are wastefully saturated. More preferably, Cr is added by 2.0% or less, Mo is added by 0.8% or less, Cu is added by 1.0% or less, Ni is added by 1.0% or less, and B is added by 0.0030% or less.

Ca: 0.0005 to 0.01%,
Mg: 0.0005 to 0.01%, and
REM: 0.0001 to 0.01% of one or at least two elements These elements are each effective for controlling a form of a sulfide in steel and thus improving workability. In the invention, Sc, Y, and lanthanoid, etc. are used as the rare earth elements (REM). To allow each element to effectively exhibit such a function, it is recommended that Ca and Mg are each added by 0.0005% or more (preferably 0.001% or more), and REM is added by 0.0001% or more (preferably 0.0002% or more). However, even if more than 0.01% of Ca, more than 0.01% of Mg, and more than 0.01% of REM are each added, the above-described effects are wastefully saturated. More preferably, Ca and Mg are each 0.003% or less, and REM is 0.006% or less.

[Warm Working Process]

The steel sheet of the invention is particularly recommended to be worked within 3600 sec (more preferably 1200 sec) after being heated to an appropriate temperature in a range of 100 to 250° C.

The steel sheet is worked under a temperature condition, at which stability of γR to be optimized, before decomposition of γR, thereby formability can be maximally improved.

A component worked by this warm working process has homogenous strength across its section after cooling. Thus, the component has a small low-strength portion compared with a component having a large strength distribution across one section thereof. Consequently, the component can have higher strength.

Specifically, a steel sheet containing γR typically has a low yield ratio, and has a high work hardening ratio in a low strain region. The steel sheet therefore has strength, particularly yield stress, having extremely large strain amount dependence after being subjected to strain application in a region where a small amount of strain is applied to the steel sheet. In the case of forming of a component by press working, the amount of applied strain is varied depending on sites of the component. As a result, a portion having almost no strain partially exists. This causes a large difference in strength between a worked region and an unworked region in a component, leading to possible formation of strength distribution in the component. In the case where a component has such strength distribution, the component is deformed or buckled due to yielding of a low-strength region; hence, the component is limited in strength by its portion having the lowest strength.

One possible reason for the low yield stress of the steel containing γR is as follows: martensite is formed along with introduction of γR while introducing mobile dislocation into a surrounding parent phase during transformation. Hence, even in a less-worked region, if such movement of dislocation is prevented, yield stress can be increased, so that a component can have higher strength. Movement of mobile dislocation is effectively suppressed by heating a material to eliminate the mobile dislocation, or by stopping the mobile dislocation by strain aging caused by dissolved carbon, and thus yield strength can be increased.

Hence, when the steel sheet containing γR is subjected to press forming (warm working) while being heated to an appropriate temperature in a range of 100 to 250° C., yield strength is increased even in a portion having small strain, and thus a component has a small strength distribution therein. As a result, the component can have higher strength.

A preferable method of manufacturing the steel sheet of the invention is now described.

[Preferable Method of Manufacturing Steel Sheet of the Invention]

The steel sheet of the invention is manufactured through hot rolling of a steel material satisfying the above-described composition, cold rolling of the steel material, and heat treatment thereof in this order.

[Hot Rolling Condition]

Although the hot rolling condition is not particularly limited, for example, hot-rolling finish temperature (rolling end temperature, FDT) may be 800 to 900° C., and coiling temperature may be 400 to 600° C.

[Cold Rolling Condition]

While the cold reduction in cold rolling is 30 to 70%, the steel sheet is heat-treated under the following heat treatment condition.

[Heat Treatment Condition]

With the heat treatment condition, the steel sheet is rapidly heated at a predetermined heating rate, and is soaked in a temperature range on a high temperature side of a two phase region of ferrite and austenite (α+γ) so that the greater part of the microstructure is austenized, and then the steel sheet is rapidly cooled at a predetermined cooling rate so as to be supercooled, and is then held at the supercooling temperature for a predetermined time so as to be subjected to austempering treatment, and consequently a desired microstructure can be produced. The steel sheet may be subjected to plating and alloying without significant decomposition of the desired microstructure and within a range without degradation of the functions of the invention.

Specifically, the cold-rolled material subjected to the above-described cold rolling is rapidly heated at a heating rate of 10° C./sec or more, and is held in a temperature range of (0.4Ac1+0.6Ac3) to (0.1Ac1+0.9Ac3) for 10 to 60 sec, and then the material is rapidly cooled to a temperature range of 350 to 500° C. (preferably 400 to 500° C.) at an average cooling rate of 10° C./sec or more so as to be supercooled, and is then held at the rapid cooling stop temperature (supercooling temperature) for 10 to 1800 sec so as to be subjected to austempering treatment, and is then cooled to normal temperature. In the case where the steel sheet must be subjected to plating and alloying, the steel sheet should be subjected to typical alloying treatment after the austempering treatment.

[Rapid Heating at Heating Rate of 10° C./sec or more]

One reason for the rapid heating is that immobilization of N by a nitride formation element such as Al is suppressed by reducing heating time to ensure a certain amount of dissolved N.

[Holding for 10 to 60 sec in Temperature Range of (0.4Ac1+0.6Ac3) to (0.1Ac1+0.9Ac3)]

The steel sheet is held for a predetermined time in the temperature range on the high temperature side of the two phase region, thereby the great part of the microstructure is austenized to ensure a certain fraction of bainitic ferrite formed through reverse transformation from austenite during the cooling. Excessively long holding time advances immobilization of N by the nitride formation element such as Al; hence, the upper limit of the holding time is specified to be 60 sec.

[Rapid Cooling to Temperature Range of 350 to 500° C. for Supercooling at Average Cooling Rate of 10° C./sec or more, and Holding for 10 to 1800 sec at the Rapid Cooling Stop Temperature (Supercooling Temperature)]

One reason for this treatment is that the desired microstructure is produced through the austempering treatment.

EXAMPLE

To confirm the effects of the invention, while the composition and the heat treatment condition were each varied, investigation was made on influence of each of the composition and the heat treatment condition on mechanical properties of the high-strength steel sheet at room temperature and in a warm range. Test steel having each composition shown in Table 1 was vacuum-fused into a slab having a thickness of 30 mm. The slab was then heated to 1200° C., and was hot-rolled into a thickness of 2.4 mm at a rolling end temperature (FDT) of 900° C. and a coiling temperature of 550° C., and was then cold-rolled at a cold reduction of 50% into a cold-rolled material 1.2 mm thick that was then subjected to heat treatment as shown in Table 2. Specifically, the cold-rolled material was heated to a soaking temperature T1° C. at an average heating rate HR1° C./sec, and was held at the soaking temperature T1° C. for a soaking time t1 sec, and was then cooled to a cooling stop temperature (supercooling temperature) T2 at a cooling rate CR1° C./sec, and was held at the temperature T2 for t2 sec, and was then air-cooled. Alternatively, assuming plating and alloying treatment, the material was further held at a holding temperature T3° C. for t3 sec after being held at the cooling stop temperature (supercooling temperature) T2° C. for t2 sec, and was then air-cooled.

Each of the steel sheets produced in this way was subjected to measurement of each of area ratio of each phase, C concentration (CγR) in γR, amount of dissolved N, and dislocation density by the measurement method described in the section of "Mode for Carrying Out the Invention".

In addition, each of the steel sheets was subjected to measurement of tensile strength (TS) and elongation (EL) at room temperature and tensile strength (TS) at 150° C. in order to evaluate mechanical properties of the steel sheet at room temperature and in a warm range. As an index for evaluating the warm-forming load reduction effect, ΔTS=(TS in a warm range (150° C.)−TS at room temperature) was calculated.

Table 3 shows results of such measurements and calculation.

| Steel | Composition (mass %) | | | | | | | | Transformation temperature (° C.) | |
|---|---|---|---|---|---|---|---|---|---|---|
| type | C | Si | Mn | P | S | Al | N | Rest | Ac1 | Ac3 |
| A | 0.18 | 1.50 | 2.00 | 0.010 | 0.001 | 0.030 | 0.0120 | — | 745 | 850 |
| B | 0.18 | 1.50 | 2.00 | 0.010 | 0.001 | 0.030 | 0.0120 | Ca: 0.010 | 745 | 850 |
| C | 0.18 | 1.50 | 2.00 | 0.010 | 0.001 | 0.030 | 0.0120 | Mg: 0.010 | 745 | 850 |
| Da | 0.01a | 1.50 | 2.00 | 0.010 | 0.001 | 0.030 | 0.0120 | — | 745 | 916 |
| Ea | 0.18 | 0.25a | 2.00 | 0.010 | 0.001 | 0.030 | 0.0120 | — | 709 | 794 |
| Fa | 0.18 | 4.00a | 2.00 | 0.010 | 0.001 | 0.030 | 0.0120 | — | 818 | 962 |
| Ga | 0.18 | 1.50 | 0.80a | 0.010 | 0.001 | 0.030 | 0.0120 | — | 758 | 886 |
| Ha | 0.18 | 1.50 | 4.00a | 0.010 | 0.001 | 0.030 | 0.0120 | — | 724 | 790 |
| Ia | 0.18 | 1.50 | 2.00 | 0.010 | 0.001 | 0.030 | 0.0040a | — | 745 | 850 |
| J | 0.18 | 1.50 | 2.00 | 0.010 | 0.001 | 0.030 | 0.0120 | Cr: 0.15 | 748 | 848 |
| K | 0.18 | 1.50 | 2.00 | 0.010 | 0.001 | 0.030 | 0.0120 | Mo: 0.20 | 742 | 856 |
| L | 0.18 | 1.50 | 2.00 | 0.010 | 0.001 | 0.030 | 0.0120 | Ci: 0.50 | 745 | 840 |
| M | 0.18 | 1.50 | 2.00 | 0.010 | 0.001 | 0.030 | 0.0120 | Ni: 0.40 | 745 | 844 |
| N | 0.18 | 1.50 | 2.00 | 0.010 | 0.001 | 0.030 | 0.0120 | B: 0.0010, Ti: 0.013 | 745 | 855 |
| O | 0.18 | 2.50 | 2.80 | 0.010 | 0.001 | 0.030 | 0.0120 | — | 766 | 871 |
| P | 0.22 | 1.50 | 2.00 | 0.010 | 0.001 | 0.030 | 0.0120 | — | 745 | 841 |
| Q | 0.12 | 2.00 | 2.50 | 0.010 | 0.001 | 0.030 | 0.0120 | — | 754 | 873 |

Subscript a: Out of the invention

TABLE 2

| Heat treatment No. | Steel type | 0.4Ac1 + 0.6Ac3 (° C.) | 0.1Ac1 + 0.9Ac3 (° C.) | Heating condition: Heating rate HR1 (° C./s) | Heating condition: Soaking temperature T1 (° C.) | Heating condition: Soaking time t1 (s) | Cooling condition: Cooling rate CR1 (° C./s) | Holding condition: Super cooling temperature T2 (° C.) | Holding condition: Holding time t2 (s) | Holding condition: Holding temperature T3 (° C.) | Holding condition: Holding time t3 (s) |
|---|---|---|---|---|---|---|---|---|---|---|---|
| 1 | A | 808 | 839 | 25 | 820 | 20 | 40 | 400 | 40 | 520 | 20 |
| 2 | B | 808 | 839 | 25 | 820 | 20 | 40 | 400 | 40 | 520 | 20 |
| 3 | C | 808 | 839 | 25 | 820 | 20 | 40 | 400 | 40 | 520 | 20 |
| 4 | Da | 848 | 899 | 25 | 860 | 20 | 40 | 400 | 40 | 520 | 20 |
| 5 | Ea | 760 | 786 | 25 | 780 | 20 | 40 | 400 | 40 | 520 | 20 |
| 6 | Fa | 904 | 947 | 25 | 920 | 20 | 40 | 400 | 40 | 520 | 20 |
| 7 | Ga | 835 | 873 | 25 | 860 | 20 | 40 | 400 | 40 | 520 | 20 |
| 8 | Ha | 763 | 783 | 25 | 780 | 20 | 40 | 400 | 40 | 520 | 20 |
| 9 | Ia | 808 | 839 | 25 | 820 | 20 | 40 | 400 | 40 | 520 | 20 |
| 10 | J | 808 | 838 | 25 | 820 | 20 | 40 | 400 | 40 | 520 | 20 |
| 11 | K | 810 | 845 | 25 | 820 | 20 | 40 | 400 | 40 | 520 | 20 |
| 12 | L | 802 | 830 | 25 | 820 | 20 | 40 | 400 | 40 | 520 | 20 |
| 13 | M | 804 | 834 | 25 | 820 | 20 | 40 | 400 | 40 | 520 | 20 |
| 14 | N | 811 | 844 | 25 | 820 | 20 | 40 | 400 | 40 | 520 | 20 |
| 15 | O | 829 | 860 | 25 | 840 | 20 | 40 | 400 | 40 | 520 | 20 |
| 16 | P | 803 | 831 | 25 | 820 | 20 | 40 | 400 | 40 | 520 | 20 |
| 17 | Q | 826 | 861 | 25 | 840 | 20 | 40 | 400 | 40 | 520 | 20 |
| 18b | B | 808 | 839 | 5b | 820 | 20 | 40 | 400 | 40 | 520 | 20 |
| 19b | B | 808 | 839 | 25 | 930b | 20 | 40 | 400 | 40 | 520 | 20 |
| 20b | B | 808 | 839 | 25 | 820 | 120b | 40 | 400 | 40 | 520 | 20 |
| 21b | B | 808 | 839 | 25 | 820 | 20 | 5b | 400 | 40 | 520 | 20 |
| 22 | B | 808 | 839 | 25 | 820 | 20 | 40 | 450 | 40 | 520 | 20 |
| 23 | B | 808 | 839 | 25 | 820 | 20 | 40 | 350 | 40 | 520 | 20 |
| 24b | B | 808 | 839 | 25 | 820 | 20 | 40 | 200b | 40 | 600 | 20 |
| 25 | B | 808 | 839 | 25 | 820 | 20 | 40 | 400 | 30 | — | — |
| 26 | B | 808 | 839 | 25 | 820 | 20 | 40 | 400 | 300 | — | — |
| 27 | B | 808 | 839 | 25 | 820 | 20 | 40 | 400 | 60 | 520 | 20 |
| 28b | B | 808 | 839 | 25 | 820 | 20 | 40 | 300b | 2000b | — | — |

(Subscript a: Out of the invention, Subscript b: Out of recommendation)

TABLE 3

| Steel No. | Steel type | Heat treatment No. | Microstructure: Area ratio (%) BF | F | M + $\gamma_R$ | $\gamma_R$ | Rest | $C\gamma_R$ (Mass %) | Amount of dissolved N (ppm) | Dislocation density ($m^{-2}$) | Mechanical properties: Room-temperature properties TS (MPa) | EL (%) | Warm properties: Temperature (° C.) | TS (MPa) | Δ TS (MPa) | Judgment |
|---|---|---|---|---|---|---|---|---|---|---|---|---|---|---|---|---|
| 1 | A | 1 | 59.6 | 21.0 | 19.4 | 12.0 | 0.0 | 0.92 | 56 | $2.8 \times 10^{15}$ | 1015 | 21.6 | 150 | 741 | 274 | ○ |
| 2 | B | 2 | 58.9 | 20.5 | 20.6 | 12.5 | 0.0 | 0.96 | 62 | $3.3 \times 10^{15}$ | 1024 | 20.1 | 150 | 758 | 266 | ○ |
| 3 | C | 3 | 59.9 | 21.7 | 18.4 | 12.1 | 0.0 | 0.94 | 60 | $2.9 \times 10^{15}$ | 1008 | 21.2 | 150 | 740 | 268 | ○ |
| 4 | Da | 4 | 25.9a | 67.4a | 6.7a | 0.0a | 0.0 | 0.00a | 61 | $1.5 \times 10^{15}$ | 567a | 28.7 | 150 | 560 | 7a | x |
| 5 | Ea | 5 | 88.5a | 11.5 | 0.0a | 0.0a | 0.0 | 0.00a | 50 | $2.5 \times 10^{15}$ | 877a | 13.0a | 150 | 880 | −3a | x |
| 6 | Fa | 6 | 21.5a | 20.2 | 58.3a | 5.7 | 0.0 | 0.59 | 68 | $13 \times 10^{15}$b | 1367 | 9.2a | 150 | 1114 | 253 | x |
| 7 | Ga | 7 | 20.3a | 60.4a | 19.3 | 11.7 | 0.0 | 0.87 | 63 | $1.6 \times 10^{15}$ | 812a | 29.2 | 150 | 630 | 182a | x |
| 8 | Ha | 8 | 20.8a | 10.8 | 68.4a | 4.2 | 0.0 | 0.59 | 60 | $2.9 \times 10^{15}$ | 1407 | 9.5a | 150 | 1157 | 250 | x |
| 9 | Ia | 9 | 58.2 | 20.8 | 21.0 | 12.5 | 0.0 | 0.97 | 20a | $2.8 \times 10^{15}$ | 1019 | 21.0 | 150 | 753 | 266 | ○ |
| 10 | J | 10 | 60.0 | 19.1 | 20.9 | 15.8 | 0.0 | 1.00 | 61 | $3.5 \times 10^{15}$ | 1065 | 20.8 | 150 | 787 | 278 | ○ |
| 11 | K | 11 | 60.4 | 25.4 | 14.2 | 12.0 | 0.0 | 0.93 | 63 | $3.4 \times 10^{15}$ | 1066 | 20.4 | 150 | 796 | 270 | ○ |
| 12 | L | 12 | 58.6 | 15.9 | 25.5 | 11.5 | 0.0 | 1.00 | 65 | $3.3 \times 10^{15}$ | 1068 | 20.8 | 150 | 802 | 266 | ○ |
| 13 | M | 13 | 59.1 | 17.2 | 23.7 | 12.2 | 0.0 | 0.96 | 59 | $2.9 \times 10^{15}$ | 1078 | 21.8 | 150 | 812 | 266 | ○ |
| 14 | N | 14 | 58.6 | 22.2 | 19.2 | 11.3 | 0.0 | 0.96 | 61 | $3.1 \times 10^{15}$ | 1069 | 21.7 | 150 | 805 | 264 | ○ |
| 15 | O | 15 | 50.5 | 21.2 | 28.3 | 17.8 | 0.0 | 0.77 | 61 | $3.4 \times 10^{15}$ | 1219 | 15.5 | 150 | 941 | 278 | ○ |
| 16 | P | 16 | 60.0 | 14.8 | 25.2 | 14.8 | 0.0 | 0.93 | 66 | $3.2 \times 10^{15}$ | 1018 | 22.9 | 150 | 743 | 275 | ○ |
| 17 | Q | 17 | 58.3 | 22.8 | 18.9 | 9.8 | 0.0 | 0.99 | 62 | $3.3 \times 10^{15}$ | 1010 | 20.4 | 150 | 740 | 270 | ○ |
| 18 | B | 18b | 60.7 | 21.8 | 17.5 | 7.1 | 0.0 | 1.09 | 21a | $2.9 \times 10^{15}$ | 1021 | 21.3 | 150 | 803 | 218a | x |
| 19 | B | 19b | 82.3 | 0.0a | 17.7 | 6.8 | 0.0 | 0.94 | 60 | $14 \times 10^{15}$b | 1030 | 15.3 | 150 | 903 | 127a | x |
| 20 | B | 20b | 57.5 | 20.3 | 22.2 | 11.3 | 0.0 | 0.63 | 18a | $2.7 \times 10^{15}$ | 1042 | 25.2 | 150 | 825 | 217a | x |
| 21 | B | 21b | 13.4a | 60.0a | 26.6 | 13.9 | 0.0 | 1.00 | 60 | $2.6 \times 10^{15}$ | 833a | 29.2 | 150 | 559 | 274 | x |
| 22 | B | 22 | 60.9 | 21.9 | 17.2 | 9.8 | 0.0 | 0.79 | 61 | $3.4 \times 10^{15}$ | 1008 | 22.4 | 150 | 746 | 262 | ○ |
| 23 | B | 23 | 56.2 | 20.3 | 23.5 | 11.1 | 0.0 | 1.19 | 63 | $7.3 \times 10^{15}$b | 1201 | 19.7 | 150 | 969 | 232 | ○ |
| 24 | B | 24b | 28.2a | 21.9 | 49.9a | 2.8a | 0.0 | 0.51 | 60 | $9.7 \times 10^{15}$b | 1523 | 7.3a | 150 | 1422 | 101a | x |
| 25 | B | 25 | 59.7 | 20.6 | 19.7 | 9.4 | 0.0 | 0.90 | 67 | $3.4 \times 10^{15}$ | 1021 | 20.8 | 150 | 760 | 261 | ○ |
| 26 | B | 26 | 58.7 | 20.4 | 20.9 | 9.6 | 0.0 | 1.08 | 66 | $3.2 \times 10^{15}$ | 1017 | 22.7 | 150 | 751 | 266 | ○ |

TABLE 3-continued

| Steel No. | Steel type | Heat treatment No. | Microstructure: Area ratio (%) BF | F | M + $\gamma_R$ | $\gamma_R$ | Rest | $C\gamma_R$ (Mass %) | Amount of dissolved N (ppm) | Dislocation density ($m^{-2}$) | Mechanical properties: Room-temperature properties TS (MPa) | EL (%) | Warm properties: Temperature (° C.) | TS (MPa) | Δ TS (MPa) | Judgment |
|---|---|---|---|---|---|---|---|---|---|---|---|---|---|---|---|---|
| 27 | B | 27 | 60.1 | 20.7 | 19.2 | 9.3 | 0.0 | 0.94 | 65 | $3.3 \times 10^{15}$ | 1006 | 20.7 | 150 | 743 | 263 | ○ |
| 28 | B | 28b | 58.0 | 20.0 | 22.0 | 9.5 | 0.0 | 1.33a | 63 | $8.3 \times 10^{15}$b | 994 | 19.0 | 150 | 913 | 81a | x |

(Subscript a: Out of the invention, Subscript b: Out of recommendation, BF: Bainitic ferrite, F: Ferrite, M: Martensite, $\gamma_R$: Retained austenite,
○: Room temperature TS ≥980 MPa and room temperature EL ≥15% and warm range Δ TS (room temperature TS − warm rangeTS) ≥230 MPa,
x: Left conditions are each not satisfied)

As shown in the Tables, any of types of steel Nos. 1 to 3 and 10 to 17 as the steel sheet of the invention was formed of a steel type satisfying the composition range of the invention, and was subjected to heat treatment under the recommended heat treatment condition. As a result, high-strength steel sheets were produced, each steel sheet satisfying the requirements for the microstructure specified in the invention, and exhibiting large elongation (EL) at room temperature and an excellent warm-forming load reduction effect (ΔTS) while having strength (TS) of 980 MPa or more at room temperature.

On the other hand, any of types of steel Nos. 4 to 9 as comparative steel was formed of a steel type that did not satisfy the requirements for the composition specified in the invention. Hence, although the steel was subjected to heat treatment under the recommended heat treatment condition, the steel did not satisfy the requirements for the microstructure specified in the invention, and was inferior in at least one of the properties of room-temperature strength (TS), room-temperature elongation (EL), and a warm-forming load reduction effect (ΔTS).

Any of types of steel Nos. 18 to 21, 24, and 28 as another comparative steel was formed of a steel type satisfying the composition range specified in the invention, but was subjected to heat treatment under a condition out of the recommended heat treatment condition. As a result, the steel did not satisfy the requirements for the microstructure specified in the invention, and was also inferior in at least one of the properties of room-temperature strength (TS), room-temperature elongation (EL), and a warm-forming load reduction effect (ΔTS).

Although the invention has been described in detail with reference to a particular embodiment, it should be understood by those skilled in the art that various alterations or modifications thereof may be made without departing from the spirit and the scope of the invention.

The present application is based on Japanese patent application (JP-2011-178477) filed on Aug. 17, 2011, the content of each of which is hereby incorporated by reference.

INDUSTRIAL APPLICABILITY

The high-strength steel sheet of the invention is preferable as a thin steel sheet for an automobile frame component, etc.

The invention claimed is:

1. A steel sheet, comprising,
by mass percent:
C: 0.02 to 0.3%;
Si: 1.0 to 3.0%;
Mn: 1.8 to 3.0%;
P: 0.1% or less, including 0%;
S: 0.01% or less, including 0%;
Al: 0.001 to 0.1%;
N: 0.01 to 0.03%; and
a remainder comprising iron and impurities, and
having a microstructure comprising phases of, by area ratio to an entire microstructure:
bainitic ferrite: 50 to 85%;
retained austenite: 3% or more;
martensite and a retained austenite in total: 10 to 45%; and
ferrite: 5 to 40%,
wherein C concentration (CγR) in the retained austenite is from 0.3 to 1.2 mass percent,
part or all of N in the composition is dissolved, and an amount of the dissolved N is from 30 to 100 ppm, and
wherein a dislocation density in the entire microstructure is $5\times10^{15}$ $m^{-2}$ or less.

2. The steel sheet of claim 1, wherein the composition further comprises, by mass percent:
Cr: 0.01 to 3.0%,
Mo: 0.01 to 1.0%,
Cu: 0.01 to 2.0%,
Ni: 0.01 to 2.0%,
B: 0.00001 to 0.01%,
Ca: 0.0005 to 0.01%,
Mg: 0.0005 to 0.01%, and
REM: 0.0001 to 0.01% of an element.

3. The steel sheet of claim 1, wherein the bainitic ferrite is present in an amount of 60 to 85%.

4. The steel sheet of claim 1, wherein the bainitic ferrite is present in an amount of 70 to 85%.

5. The steel sheet of claim 1, wherein the martensite and a retained austenite in total are present in an amount of 12 to 45%.

6. The steel sheet of claim 1, wherein the martensite and a retained austenite in total are present in an amount of 16 to 45%.

7. The steel sheet of claim 1, wherein the ferrite is present in an amount of 10 to 35%.

8. The steel sheet of claim 1, wherein the ferrite is present in an amount of 15 to 30%.

9. The steel sheet of claim 1, wherein C concentration (CγR) in the retained austenite is from 0.4 to 0.9 mass percent.

10. The steel sheet of claim 1, wherein the retained austenite is present in an amount of 5% or more.

11. The steel sheet of claim 1, wherein the retained austenite is present in an amount of 10% or more.

12. The steel sheet of claim 1, wherein the dislocation density is $4\times10^{15}$ $m^{-2}$ or less.

13. The steel sheet of claim 1, wherein the dislocation density is $3\times10^{15}$ $m^{-2}$ or less.

14. A warm forming method of a high-strength steel sheet, the method comprising heating the steel sheet of claim 1 to a temperature of from 100 to 250° C., and then forming the steel sheet within 3600 sec.

* * * * *